US005421764A

United States Patent [19]

Namiki

[11] Patent Number: 5,421,764

[45] Date of Patent: Jun. 6, 1995

[54] WATER GAME FOR PROPELLING PLAY MEMBERS THROUGH AIR

[75] Inventor: Takao Namiki, Tokyo, Japan

[73] Assignee: Tomy Company Ltd., Tokyo, Japan

[21] Appl. No.: 78,117

[22] Filed: Jun. 18, 1993

[30] Foreign Application Priority Data

Jun. 19, 1992 [JP] Japan ..... 4-184767

[51] Int. Cl.[6] ..... A63H 29/14

[52] U.S. Cl. ..... 446/197; 446/267; 273/457

[58] Field of Search ..... 446/197, 171, 167, 168, 446/176, 180, 267; 273/457; 40/406, 439, 477, 409

[56] References Cited

U.S. PATENT DOCUMENTS 2,785,895 3/1957 Neveling, Sr. ..... 40/406 X
2,869,874 1/1959 Berdner ..... 273/349 X
3,477,723 11/1969 Djedda ..... 446/167 X
4,079,937 3/1978 Kirsch ..... 273/119 B X
4,496,329 1/1985 Kubiatowicz ..... 446/267 X
4,508,336 4/1985 Yokoi ..... 273/457
5,017,171 5/1991 Shina ..... 446/197

FOREIGN PATENT DOCUMENTS 1532127 11/1978 United Kingdom .

*Primary Examiner*—Mickey Yu
*Attorney, Agent, or Firm*—Staas & Hasley

[57] ABSTRACT

A water toy is provided with play members in a game body which is at least partially filled with air. The water toy has a fountain generating mechanism for generating a stream of liquid in the air of the game body to propel the play members through the air. The play members may be caught by receiving elements.

4 Claims, 4 Drawing Sheets

WATER GAME FOR PROPELLING PLAY MEMBERS THROUGH AIR

BACKGROUND OF THE INVENTION

1. Field of the Invention

The present invention relates amusement devices in general and, more specifically, to amusement devices in which game bodies are moved by a jet of liquid.

2. Description of the Related Art

Related art toys in which a game body is moved by a jet of water are known. Such a related art toy is described, for example, in Japanese Utility Model Publication No. HSO 54-312. Toys of this kind have a water tank which is almost completely full of water. In the water tank are underwater play members, such as rings and balls. The underwater play members have a specific gravity which is slightly greater than the specific gravity of water. Related members, such as bars and receiving boards, are mounted in the water tank to receive the underwater play members. A compression member produces an upward stream of water for propelling the underwater play members toward the related members. Then, as the underwater play members fall downward with gravity, some of them are received by the related members while others are not. Therefore, the toy can be played like quoits, in which rings are received by bars, or like an underwater holing game, in which balls are received in holes.

The toys of the related art are disadvantageous in that, because the underwater play members have a specific gravity which is slightly greater than water, the underwater play members fall very slowly in the water. Therefore, although the game can be played in a relaxed frame of mind, it is also slow and tedious. Furthermore, because the water tank is almost completely full of water, a stream of water cannot be seen by a player of the game. Only the motion of the underwater play members can be seen. Thus, the game is relatively monotonous and there is room for improvement.

SUMMARY OF THE INVENTION

An object of the present invention is to provide a game in which a jet of liquid propels game bodies through air.

Another object of the present invention to provide a water toy in which the stream of water can be seen and therefore the toy is visually very interesting.

A further object of the invention to provide a water toy in which the game can be played at a more rapid pace than that of the related art.

According to the present invention, a water toy having a body, game bodies within the body and a fountain generating means is provided. The body is at least partially filled with air. The fountain generating means generates a stream of liquid to propel the game bodies through the air in the body.

Because the stream of liquid is generated in air, the player can watch as the game bodies are propelled by the stream. Furthermore, because the body is at least partially filled with air, the game bodies are more quickly propelled through the body.

BRIEF DESCRIPTION OF THE DRAWINGS

Hereinafter, a preferred embodiment of the invention will be described with reference to the accompanying drawings, in which.

DESCRIPTION OF THE PREFERRED EMBODIMENT

Figure 1:
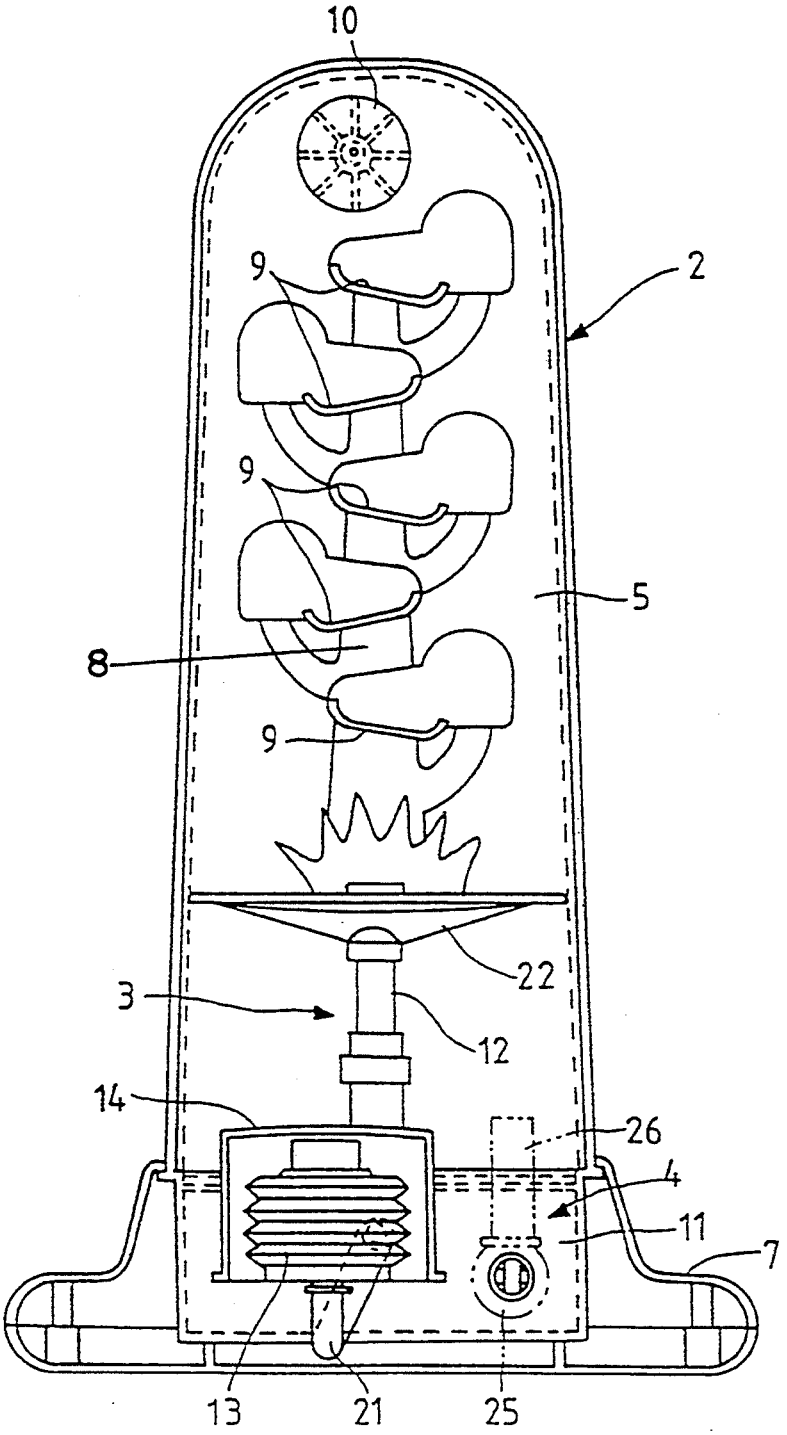
FIG. 1 is a front view of a water toy according to the present invention.
Figure 2:
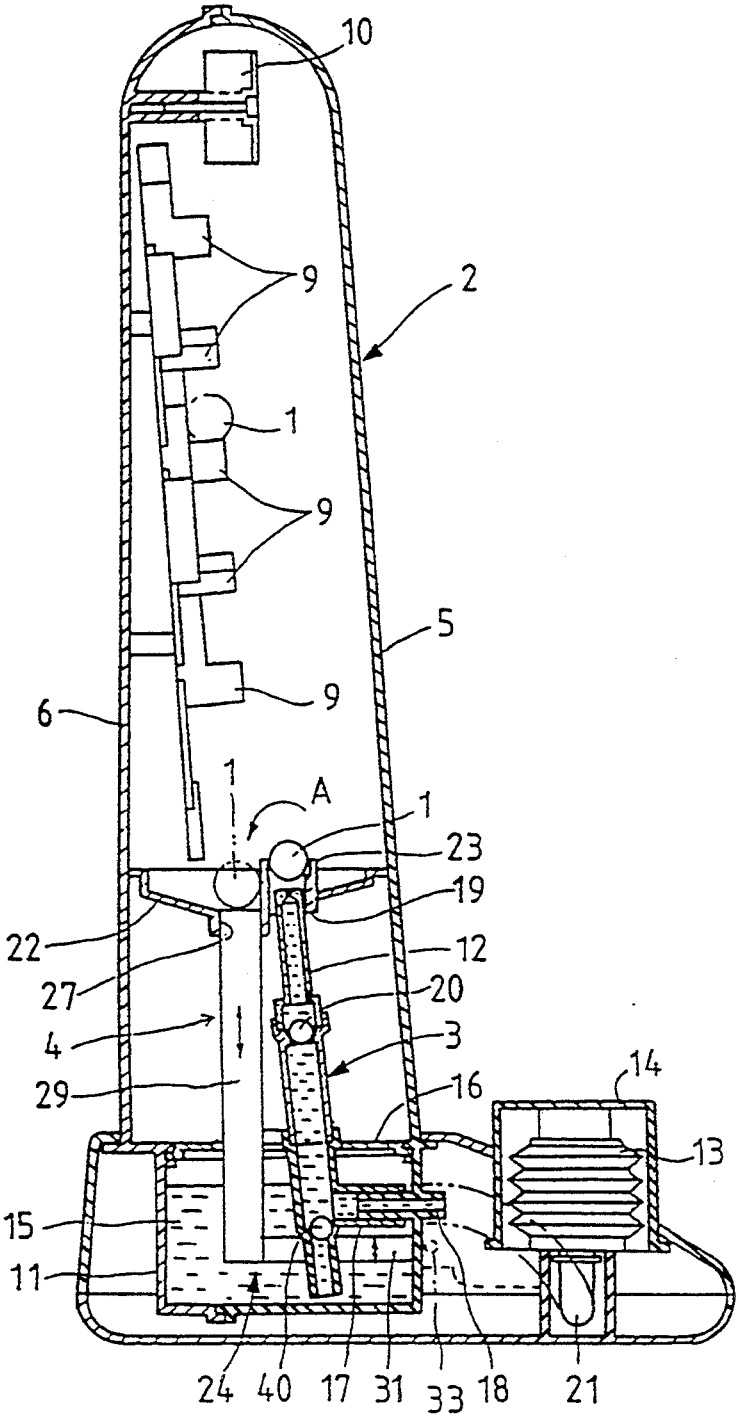
FIG. 2 is a cross-sectional side view of the water toy shown in FIG. 1.

As shown in FIGS. 1 and 2, a water toy according to the present invention includes a hollow body 2 which holds a plurality of game bodies such as balls 1. A fountain generating mechanism 3 is provided for generating a stream of liquid, such as water, into the air of the body to propel balls 1 through the air. The water toy has contact elements 9 within the body positioned in the vicinity of the stream of water which is generated by the fountain generating means. The water toy also has a play member setting mechanism 4 (ball setting mechanism) for setting balls 1 in a position where balls 1 can be blown upward by fountain generating mechanism 3.

As shown in FIG. 2, body 2 is manufactured to be watertight by fitting a front case 5 and a rear case 6 to one another and securely mounting front and rear cases 5, 6 on a hollow base 7. The front case 5 of the body 2 is formed from a transparent plastic material, for example. The front face of front case 5 is inclined slightly rearwardly. Rear case 6 can be either transparent or opaque, is typically formed of a plastic material, and is mounted upright on base 7. A tree-shaped support board 8 (FIG. 1) is positioned toward the rear of body 2 and is nearly parallel with the front face of front case 5. Support board 8 is secured with screws to rear case 6. As contact elements, five circular receiving plates 9 are provided in the body which are large enough to accommodate at least one ball. Receiving plates 9 are mounted to support board 8 at equal vertically spaced intervals, and are open so as to face a direction generally opposite to that which the liquid stream exits fountain generating means 3.

The water toy also has a water wheel 10 rotatably supported above support board 8. Wheel 10 is positioned in the vicinity of the stream of water and is turned by the stream of water for decorative purposes.

Fountain generating mechanism 3 comprises a water tank 11 containing a liquid 15, such as water, which serves as the source of liquid for the fountain. A jet tube 12 blows the liquid upward as a water jet. A watertight bellows 13 is connected to the jet cylinder 12. When a pushbutton 14 is depressed, a bellows 13 is compressed and thereby the water in the bellows is also compressed. In this manner, a water jet is produced.

Water tank 11 is formed in the lower end of body 2 and extends as far as the vicinity of the bottom of base 7. An opening at the upper end of water tank 11 is covered with an intermediate plate 16 which is affixed to body 2. The lower end of jet cylinder 12 is located near the bottom of water tank 11, as shown in FIG. 2, so that it is immersed in the liquid 15. Jet cylinder 12 extends through an opening in intermediate plate 16 and has a top end which is in front of the bottom of the support board 8 within body 2. Jet cylinder 12 is nearly parallel to support board 8. A pipe 17 is formed in a middle region of jet cylinder 12 and is inserted in one end of a socket 18 which is formed in the front wall of water tank 11. In this manner, jet cylinder 12 is secured to body 2. A nozzle 19 is formed in the upper end of jet cylinder 12, and a water injection valve 20 is positioned between the top end and the middle region of jet cylinder 12. A suction valve 40 is positioned between the bottom end and the middle region of the jet cylinder 12. Valves 20, 40 function as ballcock check valves which only allow an upward flow of liquid 15. The injection valve 20 opens when the pressure in the middle region of jet cylinder 12 is greater than the pressure at the top end. Suction valve 40 opens when the pressure in the middle region of jet cylinder 12 is less than the pressure at the bottom end.

A pipe 21 is connected at one end to the outer end of socket 18. The other end of pipe 21 is connected to the large bellows 13. Bellows 13 protrudes outwardly from the front section of base 7. Pushbutton 14 encloses bellows 13 and contracts bellows 13 when a manual force is applied to pushbutton 14. Liquid 15 fills each of the above components, i.e., jet cylinder 12, bellows 13 and associated elements.

Ball setting mechanism 4 consists of a play member receiving dish (ball receiving dish) 22 for receiving the balls 1 falling within body 2. To set a ball 1 for play, a link mechanism 24 moves a single ball from the ball receiving dish 22 to a ball rest 23. Ball rest 23 is positioned above the fountain generating means and has a circumference large enough to support a ball 1. Ball rest 23 has an open top and an open bottom which are linearly spaced along an axis which is coaxial with the stream of water so that ball rest 23 does not impede the stream of water. Ball set mechanism 4 also includes a small bellows 25 for holding the link mechanism 24 watertight and a pushbutton 26 for operating link mechanism 24.

Ball receiving dish 22 is positioned horizontally in body 2 at the lower end of the support board 8. The circumference of receiving dish 22 corresponds substantially with the circumference of body 2 so that all falling balls 1 must be received by ball receiving dish 22. Ball receiving dish 22 has a U-shaped opening 27 at its lowest point. Ball rest 23 is formed integrally with ball receiving dish 22 and is adjacent to and slightly higher than opening 27.

Figure 3:
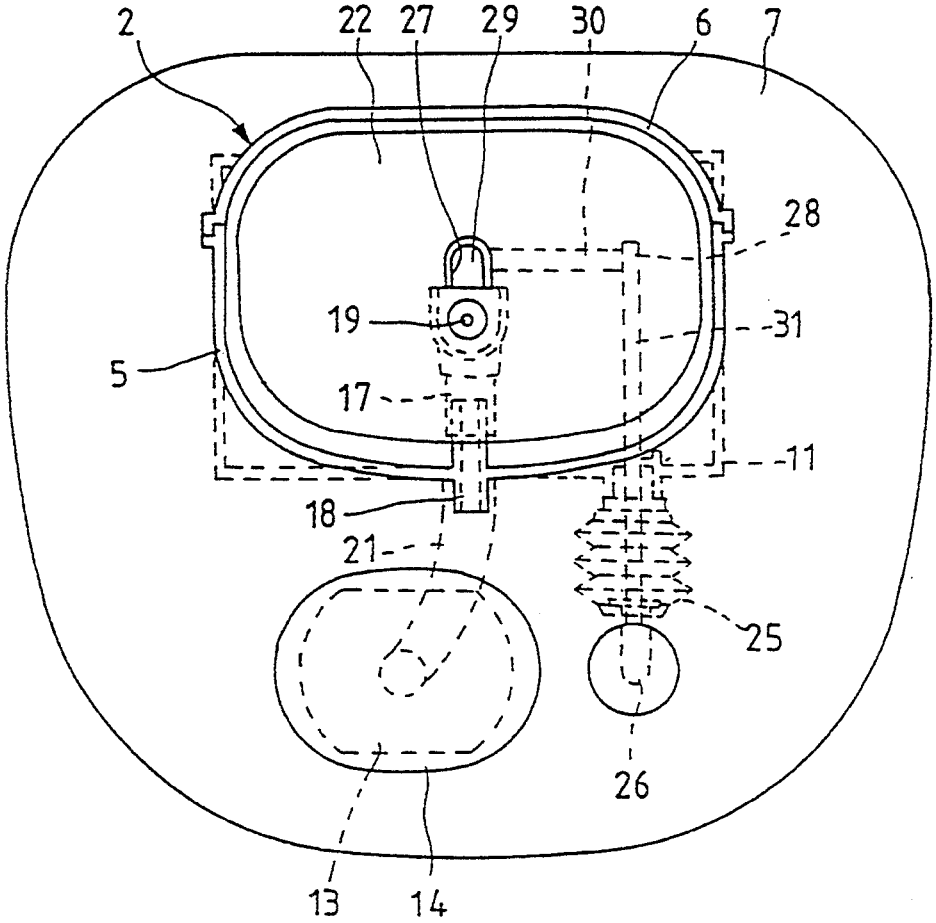
FIG. 3 is a plan view of a fountain generating mechanism and a ball setting mechanism of the water toy shown in FIG. 1.
Figure 4:
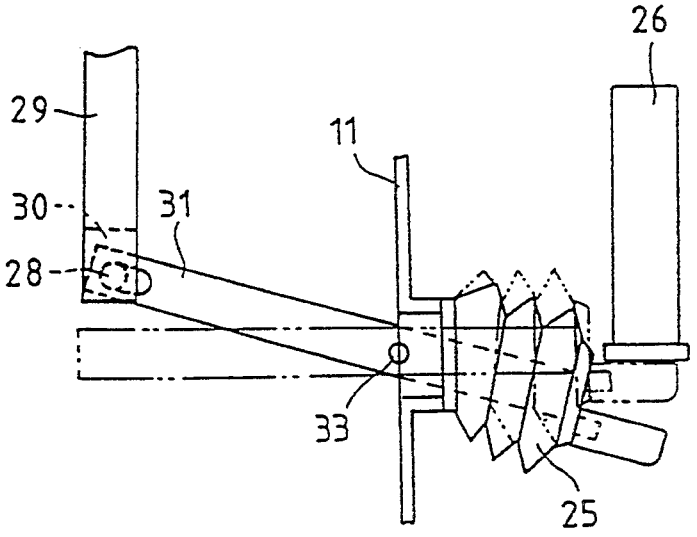
FIG. 4 is a side view for illustrating the operation of a lever and a small bellows of the ball setting mechanism shown in FIG. 3.

As seen in FIG. 4, link mechanism 24 is comprised of a first lever 29 which extends vertically (parallel with the stream of water) and second and third levers 30, 31 which extend horizontally (perpendicular to lever 29). First and second levers 29, 30 are connected to one another, and second and third levers 30, 31 are rotatably connected with each other by a pin 28 (a first fulcrum) formed on one end of second lever 30 which seats in a hole located in an end of third lever 31. Lever 29 extends through an opening in intermediate plate 16 so that its upper end is slidably fitted into opening 27, which is at the lowest point in game ball receiving dish 22. A lower end of lever 29 is immersed in the liquid 15 in the water tank 11. Lever 29 is movable between a first position in which its upper end is positioned in opening 27 and a second position in which its upper end is positioned slightly above ball rest 23. As shown in FIG. 3, second and third levers 30, 31 extend horizontally in the lateral and longitudinal directions, respectively, in the liquid 15 of water tank 11. As seen in FIGS. 3 and 4, lever 31 extends outward through a wall of water tank 11 and is rotatably supported on a second fulcrum 33 formed in the wall of water tank 11. On the outer end of third lever 31 is vertically fixed a pushbutton 26 for setting a ball 1. Bellows 25 has a first end which surrounds lever 31 and is watertight therewith, and a second end which is bonded to water tank 11 to be watertight therewith.

Operation of the water toy will be now described. First, setting of a ball 1 on ball rest 23 will be described. Assuming that a plurality of balls 1 are present on ball receiving dish 22, one of the balls 1 will fall into opening 27 and rest on the upper surface of first lever 29 of link mechanism 24. When pushbutton 26 is manually depressed, the third lever 31 turns on the center of the second fulcrum 33 as indicated by full lines in FIG. 4. Thus, the outer end of lever 31 is moved away from ball rest 23 and the inner end of lever 31 is moved toward ball rest 23. In this manner, first and second levers 29, 30 are pushed upward through the first fulcrum 28. With this movement, the small bellows 25 deflects downwardly with the rotation of lever 31, as shown by full lines in FIG. 4. The first lever 29 moves to its second position in which it protrudes upwardly through opening 27 in ball receiving dish 22, guided by intermediate plate 16. In this manner, the ball 1 is moved upward onto the adjacent ball rest 23 and the setting of the ball 1 is completed.

When the pressure is released from pushbutton 26, link mechanism 24 moves in a direction opposite to that described above under the force of gravity and the resiliency of bellows 25. That is, the first lever 29 moves downwardly from opening 27 of the ball receiving dish 22. The position of link mechanism 24 when pressure has been removed from pushbutton 26 is shown in phantom lines in FIG. 4. With lever 29 at the bottom of opening 27, the next ball 1 falls into opening 27 onto lever 29.

Now, with the ball set on ball rest 23, pushbutton 14 can be depressed for causing a stream of water to be produced. By depressing pushbutton 14, bellows 13 contracts, compressing the liquid inside to increase the pressure in the middle region of jet cylinder 12. This causes suction valve 40 to close and injection valve 20 to open. In this manner, liquid 15 is jetted out of nozzle 19 into the interior of body 2. One playing with the water toy can visually enjoy the fountain appearance of the liquid 15 jetting out, as well as enjoying the sight of waterwheel 10 being turned by liquid 15.

In the meantime, ball 1 is now in play and is being blown upwardly by the liquid 15 being jetted from nozzle 19. The ball 1 passes through a space between front case 5 and support board 8 while turning in a counterclockwise direction, i.e., the direction shown by the arrow A in FIG. 2. When ball 1 eventually begins to fall, it possibly rebounds from front case 5 and support board 8. The ball 1 may be received by any one of the five receiving plates 9 of support board 8, or the ball may not be received by any of receiving plates 9. A ball in play that is received by the receiving plates is considered a successful ball, and a ball in play that is not received by receiving plates is considered an unsuccessful ball.

Bellows 13, which was contracted by pressure being applied to pushbutton 14, will begin expanding with its elasticity when pressure is removed from pushbutton 14. In this manner, pressure in the middle region of jet cylinder 12 will be decreased. This causes injection valve 20 to close to stop liquid from flowing from nozzle 19 side to bellows 13 side. The decreased pressure also causes suction valve 40 to open, which allows liquid to be supplied from water tank 11 through the bottom end of jet cylinder 12 and through suction valve 40 to bellows 13. Note that the supply of liquid 15 to bellows 13 is automatic and occurs after liquid 15 is ejected from nozzle 19 and pressure is removed from pushbutton 14. Thus, the water toy automatically prepares itself for the next ball 1 waiting on ball receiving dish 22 to be propelled into body 2. This enables the balls to be quickly blown upwardly in succession.

The liquid 15 is capable of jetting out into body 2 because balls 1 and fountain generating mechanism 3 are held watertight within body 2. The liquid 15 is easily gathered by ball receiving dish 22, which has a circumference substantially equal to that of body 2. The liquid so received by ball receiving dish 22 is returned to water tank 11 when the first lever 29 is within hole 27 because lever 29 is hollow and has a lower end within water tank 11.

In the water toy described above, a fountain is generated within body 2 by fountain generating mechanism 3. This fountain can be visually enjoyed. Furthermore, a game can be more quickly played as the water jet is used to blow balls 1 within body 2 which is at least partially filled with air, because the jet of liquid passes though air and is therefore visible to the player. The fountain can be produced easily by depressing pushbutton 14, and the ball 1 can be easily set by depressing pushbutton 26. Moreover, because the water toy automatically prepares itself for setting another ball and producing another fountain, the game can be played more quickly than those of the related art. Also, because the balls and fountain generating mechanism are watertight within the body, the liquid will not leak out and the game can be played anywhere, even indoors.

Various modes of playing the game are possible. For example, if a player lands a ball 1 in the top one of the five receiving plates 9, the player will score five points. If the player lands a ball 1 in one of the lower receiving plates 9, the score decreases respectively. When all of the balls have been finished, the score is tabulated and the winner of the game is determined.

Although an embodiment of the present invention has been described above, the present invention is not limited to such embodiment, and numerous modifications and variations may be made without departing from the scope of the present invention.

For example, the balls and fountain generating mechanism have been described as being housed within a body. However, the body may be dispensed with. In this case, liquid jetted out from the fountain generating mechanism will scatter, and the toy will be suitable for use outdoors and in the bathroom.

Furthermore, support board 8 which supports ball receiving plates 9 has been described as being tree shaped. However, the support board is not limited to this shape.

A temporary ball rest may be provided above the ball receiving plates. To play the game, a ball would first be set on the temporary ball rest. Then, as the fountain is generated, the ball is knocked off the temporary ball rest to fall downward and possibly onto one of the receiving plates.

Also, pins and holes may be used instead of receiving plates. This would allow the game to be played like a pachinko game in place of a holing game, as described above. Moreover, although five ball receiving plates 9 have been described, any suitable number of game body receiving elements may be used.

The balls have been described as balls which float within the body. However, game bodies other than balls may be used as floating members.

According to the water toy of the present invention, a game may be played by moving balls in air by the use of a water jet generated by a fountain generating mechanism. The water toy, including the water jet, is therefore visually very interesting. The water toy also has the advantage that it is possible to play the game at a quicker pace than was previously possible.

I claim:

1. A water toy comprising:

a game body at least partially filled with air;

at least one play member located within the game body;

fountain generating means for generating and otherwise controlling a stream of liquid in the air of the game body to propel the at least one play member through the air of the game body;

at least one contact dement within the game body at a position in the vicinity of the stream of liquid so that the at least one play member can contact the at least one contact element;

a play member rest positioned above the fountain generating means and having a circumference large enough to,support at least one play member, the play member rest having an open top and an open bottom which are linearly spaced along an axis which is coaxial with the stream of liquid; and play member setting means for setting the at least one play member on the play member rest, the play member setting means comprising:

a play member receiving dish having a lowest point at which the at least one play member falls to;

a contacting lever generally parallel with the stream of liquid, the contacting lever being movable from a first position in which an upper end is positioned at the lowest point of the play member receiving dish and a second position at which the upper end is positioned slightly above the play member rest;

an activation lever perpendicular to the contacting lever and having inner and outer ends, the outer end extending through a wall of the game body, the activation lever pivoting about a pivot point so that when the outer end is moved away from the play member rest, an inner end is moved towards the play member rest;

connection means for connecting the contacting lever to the inner end of the activation lever to move the upper end of the contacting lever with the inner end of the activation lever; and small bellows having first and second ends, the first end being watertight with the game body and the second end being watertight with the activation lever at a point exterior to the game body and interior to the outer end of the activation lever.

2. The water toy as claimed in claim 1, further comprising a water tank wherein the play member receiving dish has a circumference which corresponds to a circumference of the game body and the contacting lever is hollow and has a lower end positioned in the water tank so that liquid received by the play member receiving dish is transmitted to the water tank when the contacting lever is in the first position.

3. A water toy, comprising:

a game body at least partially filled with air;

at least one play member located within the game body;

fountain generating means for generating and otherwise controlling a stream of liquid in the air Of the game body to propel the at least one play member through the air of the game body; the fountain generating means comprising:

a water tank;

a tube having a middle region and top and bottom ends, the bottom end being within the water tank and the top end being within the game body;

a water injection valve positioned between the top end of the tube and the middle region of the tube for opening when the pressure in the middle region of the tube is greater than the pressure at the top end of the tube;

a suction valve between the bottom end of the tube and the middle region of the tube, the suction valve opening when the pressure at the middle region of the tube is less than the pressure at the bottom end of the tube;

large bellows connected to the middle region of the tube; and contracting means for contracting the large bellows by a manual force to thereby increase the pressure in the middle region in the tube and for allowing the large bellows to expand when the external force is removed to thereby decrease the pressure in the middle region of the tube; and at least one contact element within the game body at a position in the vicinity of the stream of liquid so that .the at least one play member can contact the at least one contact element.

4. The water toy as claimed in claim 3, wherein the fountain generating means further comprises a directing nozzle at the top end of the tube, the directing nozzle directing liquid to one side of the at least one play member to move the at least one play member in a counterclockwise direction as the at least one play member is being propelled.

* * * * *

UNITED STATES PATENT AND TRADEMARK OFFICE

CERTIFICATE OF CORRECTION

PATENT NO. : 5,421,764

DATED : June 6, 1995

INVENTOR(S) : Namiki

It is certified that error appears in the above-indentified patent and that said Letters Patent is hereby corrected as shown below:

Col. 6, line 26, after "to" delete ",".

Col. 7, line 2, change "Of" to --of--.

col. 8, line 11, after "that" delete "."

Signed and Sealed this

Twenty-sixth Day of September, 1995

*Attest:*

Bruce Lehman

BRUCE LEHMAN

*Attesting Officer*

*Commissioner of Patents and Trademarks*